United States Patent [19]

Kroneck

[11] Patent Number: 4,723,820

[45] Date of Patent: Feb. 9, 1988

[54] ONE-ROOM DOLL HOUSE

[76] Inventor: Grant Kroneck, P.O. Box 733, N.Y. 13409

[21] Appl. No.: 867,044

[22] Filed: May 27, 1986

[51] Int. Cl.[4] ..... A47B 77/08

[52] U.S. Cl. ..... 312/223; 52/221; 312/257 A; 362/133

[58] Field of Search ..... 312/257 A, 263, 264, 312/114, 214, 223; 403/DIG. 1; 52/28, 221; 446/477; 362/127, 133

[56] References Cited

U.S. PATENT DOCUMENTS

| | | | |
|---|---|---|---|
| 1,397,269 | 11/1921 | Dodge | 312/214 |
| 1,481,560 | 1/1924 | Ringer | 312/214 X |
| 1,643,738 | 9/1927 | Brooks | 312/214 X |
| 1,773,608 | 8/1930 | Wilson et al. | 312/214 X |
| 2,142,804 | 1/1939 | Rockola | 362/133 |
| 2,837,734 | 6/1958 | Bowie | 362/127 X |
| 3,511,942 | 5/1970 | Quigley | 52/28 X |
| 3,661,435 | 5/1972 | Miller | 312/223 X |
| 4,244,476 | 1/1981 | Tang | 403/DIG. 1 |
| 4,422,385 | 12/1983 | Rutsche et al. | 108/23 X |
| 4,612,746 | 9/1986 | Higgins | 52/221 |
| 4,653,239 | 3/1987 | Randa | 52/221 X |

*Primary Examiner*—James T. McCall

*Attorney, Agent, or Firm*—Bruns and Wall

[57] ABSTRACT

A display assembly for miniatures comprises a case with a rear wall panel, side wall panels, and floor and ceiling panels which can be removed and reinserted. The floor and ceiling panels are supported in grooves in side support members within the case and these floor and ceiling panels slide into place to hold the rear panel. The side panels have spacers which project beyond the rear edges of the side panels to fit into recesses in the rear panel. This construction also provides adequate spacing between the case walls and the interior walls, floor and ceiling panels so that wiring for miniature lamps and other appliances can be run.

2 Claims, 4 Drawing Figures

ONE-ROOM DOLL HOUSE

BACKGROUND OF THE INVENTION

This invention relates to display apparatus and is more particularly directed to a miniature building structure, such as a doll house or the like, in which miniatures, such as doll house type furniture, miniature lamps, toys or other items can be arranged to resemble a miniature room. The invention further relates to such display structure which can serve as a lamp, or as a stand on which a lamp, a plant, or other household furnishing can be supported.

Various toy structures have been made and sold, including doll houses, toy stores, model railroad stations, etc., in which small figures, dolls and miniature furnishings are displayed. Some of these may have a glass wall on one side through which the interior of the doll house can be viewed. Display boxes for showing three dimensional objects are also well known.

However, no one has previously proposed a miniature display assembly which can be constructed to create a space for wiring between the interior and exterior walls, which can be dissembled and assembled readily and simply without requiring special tools, and which will nonetheless remain securely, yet releasably, held together.

Moreover, if a person desires to carpet, paint or wallpaper the floors or walls of a conventional dollhouse or like miniature structure, he or she faces a difficult and tedious task because the walls, floors, and ceilings must be carpeted or painted or papered in place. This would be a much easier task if the walls, ceilings and floors could be easily removed and later replaced.

OBJECTS AND SUMMARY OF THE INVENTION

It is an object of this invention to provide a novel miniatures display assembly having capabilities not attained in devices of the prior art.

It is another object of this invention to provide a display assembly which is arranged so that the interior floor, ceiling and wall panels slide together and are held in place without separate fastening means.

It is another object of this invention to provide a display assembly which is arranged so that spaces for wiring are provided between the outer case walls and the interior floor, ceiling, and wall panels.

In accordance with one aspect of this invention, the display apparatus has an outer case, vertical support members and wall, ceiling, and floor panels, with a framed window at the front of the case. The case has a back wall, a bottom wall, a roof or top wall, and a pair of side walls with the support members being disposed respectively against the inner sides of the case side walls. Each support member has an upper horizontal groove near the upper edge and a lower horizontal groove near the lower edges. These grooves are spaced somewhat from the case top and bottom walls, respectively.

A removable rear panel is held in place only by the cooperating ceiling and floor panels, and extends across the rear of the case and from the bottom to the top wall. This rear panel has recesses in its side edges extending from the position of the upper groove down to a position below the upper groove, and from the position of the lower groove upwards to a position above the lower groove. Cutouts can be provided at each of the top, bottom, and side edges of the rear panel for passing wiring from behind the rear panel. Spacers are provided, preferably on the back surface of the rear panel, to create a space between it and the case rear wall.

As aforesaid, floor and ceiling panels slide into the grooves in the support member and hold the rear panel in place. The side wall panels extend vertically from the floor panel to the ceiling panel and horizontally from the front of the case to and against the rear panel. Spacer strips along the top and bottom edges of the side panels space the same from their associated side support members, and these each have an extension or protrusion that extends beyond the rear edge of the side panels. These protrusions fit into the upper and lower side edge recesses of the rear panel and hold the side panels in place. Optimally, similar protrusions or extensions are provided at the front edge of the side panels to fit sockets or recesses in the front window.

The front window has a frame surrounding a clear panel of glass or transparent plastic. The frame is formed of upper and lower horizontal frame members and of left and right upright frame members. These frame members have recesses at their outer rear edges so that the frame members fit within the case walls and against the forward edges of the floor, ceiling, and side panels. The breadth of the frame members is substantially equal to the thickness from the case exterior surface to the associated panel interior surface so that the inner edge of the frame is substantially flush with the inner sides of the floor, ceiling, and wall panels. Magnetic closures are employed to removably secure the frame within the front of the case.

Miniature electric lamps, ceiling fans, or other appliances can be installed in the display space. These can be powered by wiring that runs from behind the rear panel, through one of the cut-outs therein, and through the space between the case and the panels. This wiring can provide low-voltage power, as appropriate to the miniature appliances. The wiring can exit this space through small holes in the floor, ceiling, or side wall panels to feed current to the appliance or appliances.

In a favorable embodiment, the case size is about sixteen by twelve by twelve inches, and a lamp can be affixed to its top wall or roof.

The above and many other objects, features and advantages of this invention will be more fully appreciated from a consideration of the ensuing description of a preferred embodiment which is to be read in conjunction with the accompanying drawing.

DETAILED DESCRIPTION OF THE PREFERRED EMBODIMENT

Figure 1:
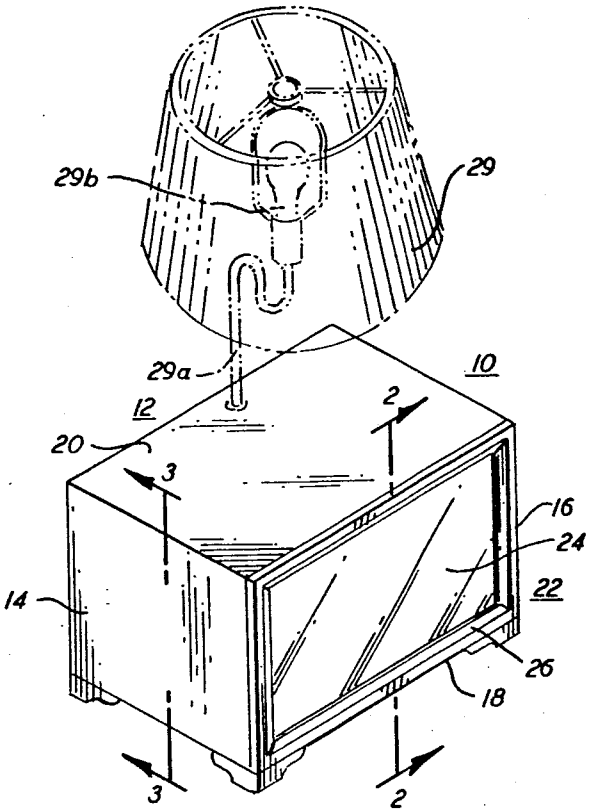
FIG. 1 a perspective view of the miniatures display assembly according to one embodiment of the invention.

With reference to the drawing, and initially to FIG. 1 thereof, a one-room doll house for like miniatures display assembly 10 according to one embodiment of this invention is basically constructed with a rectangular parallelipiped case 12 having a left side wall 14, a right side wall 16, a base or bottom wall 18, and a top wall 20. The front of the case 12 is comprised of a window 22 having a rectangular glass panel 24 and a surrounding frame 26 which fits into the front of the case 12. A rear wall 28 (FIG. 2) closes off the back of the case 12. Optionally, and as shown in ghost in FIG. 1, this embodiment can include a built-in lamp 29 with a stem 29(*a*) fastened to the upper or top wall 20 of the case 12 through an opening therein. The stem 29(*a*) supports a light unit 29(*b*), here formed of a socket or oulb holder, bulb, harp, and shade. Wiring for this lamp runs from within a space at the under side of the top wall 20, through the stem 29(*a*), to the light unit 29(*b*). The attached lamp 29 is optional, and the case top wall 20 could be provided without the penetration and can serve, for example, as a platform on which a lamp, planter or other item can be reposed.

Figure 2:
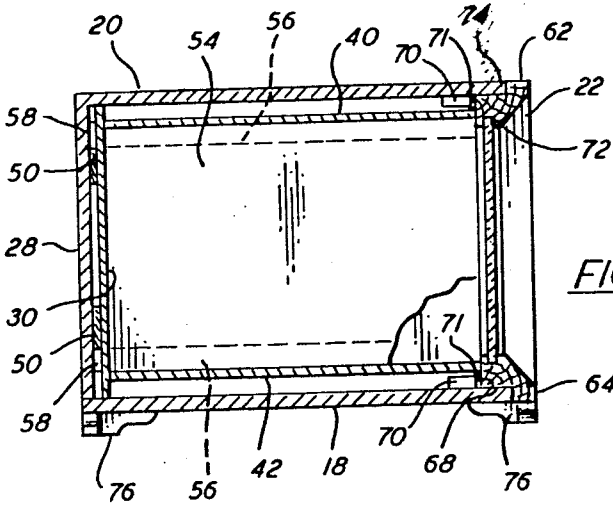
FIG. 2 is a side elevation, partly cut away, of this embodiment.
Figure 3:
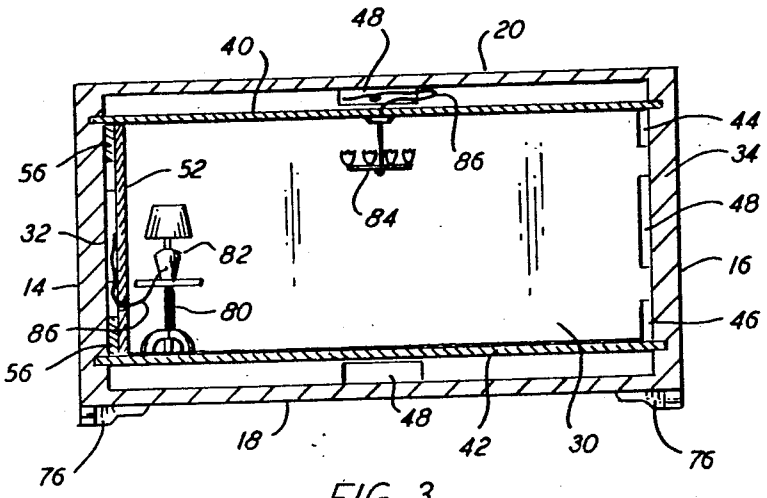
FIG. 3 a front elevation, partly assembled, of this embodiment.

As further shown in the side elevation of FIG. 2 or the front elevation of FIG. 3, a rear panel 30 is removably situated within the case 12 near the rear wall 28 thereof. Left and right side support panels 32 and 34 are disposed within the case against the respective side walls 14 and 16. Each of these panels 32 and 34 has a lower slot or groove 36 spaced up from the bottom wall 18 and an upper slot or groove 38 spaced down from the top wall 20. The grooves are plainly shown in FIG. 4 with reference to panel 34. A rectangular ceiling panel 40 and a rectangular floor panel 42 slide into the opposed slots 38 and 36, respectively. The rear panel 30 has upper recesses 44 at the upper part of each side edge of the panel 30, extending downwards from the location of the slots 38, and has lower recesses 46 at each side edge extending upwards from the location of the slots or grooves 36. Cut-outs 48 at the center of the top, bottom, and side edges of the rear panel 30 provide access for wiring from behind the rear panel 30. A plurality of spacer blocks 50 on the rear surface of the rear panel 30 define a space between the case rear wall 28 and the rear panel 30.

A left side wall panel 52 and a right side wall panel 54 each fit vertically between the ceiling panel 40 and the floor panel 42. Each of these panels 52 and 54 has spacer strips 56 extending along its upper and lower edges. The spacer strips 56 serve to define a space between the wall panel 52 or 54 and its associated side support panel 32 or 34, respectively. The spacer strips 56 have projections or protrusions 58 extending rearward of the rear edges of the panels 52 and 54, and these projections 58 fit into the upper and lower recesses 44 and 46 of the rear panel 30. Optional forward projections 60, shown in FIG. 4 in phantom outline, can extend forward of the front edge of the side panels 52 and 54 to fit into optional recesses in the frame 26 of the front window 22.

The front window frame 26 is comprised of an upper horizontal member 62, a lower horizontal member 64, and left and right vertical upright members 66. Each of these members has a recess 68 so that the frame 26 fits within the front part of the case walls 14, 16, 18 and 20, and also against the front edges of the panels 40, 42, 52, and 54. A pair of magnetic closure devices are used to removably secure the front window frame 26 to the case 12. A magnet 70 is secured to the inside of the bottom wall 18 while a similar magnet 70 is secured to the underside of the top wall 20. The magnets are arranged to coact with permeable metal plates 71, 71 (FIG. 2) secured to the lower horizontal frame member 64 and upper horizontal frame member 62, respectively. The magnets are recessed inside the case a sufficient distance so that the window 22 fits flush against the front face of the case at closure as shown in FIG. 2.

In the assembly of this embodiment legs 76 are attached to the bottom wall 18 at each of its corners.

As shown in FIG. 3, the display assembly of this invention can house miniature furniture and appliances, including in this example a miniature table 80 with a miniature electric table lamp 82 thereon, as well as a miniature ceiling fixture 84 suspended from the ceiling panel 40. Wiring 86 for powering the lamp 82 and the ceiling fixture 84 extends from the space behind the rear panel 30, out through the cut-outs 48, to the space defined between the support panel 32 and the wall panel 52, and to the space between the ceiling panel 40 and the case top wall 20. The wiring then penetrates these panels 40 and 52 through small holes, and connects to the respective lamp 82 and fixture 84.

In the case of the optional lamp 29, the lamp cord would also extend from the space behind the rear panel, through the cut-out 48 into the space between the ceiling panel 40 and the top wall 20, and then up through the hollow stem 29(*a*) to the lamp unit 29(*b*).

The wiring 86 for the lamp 82 and fixture 84 is of low voltage (i.e. 6 or 12 volts) which can be fed from a conventional transformer power supply (not shown).

The dimensions of the case shown in this embodiment are approximately twelve inches high, by twelve inches deep, by sixteen inches across. It should be understood, however, that a one-room doll house of this type can be of any desired dimension. In this case, the breadth of the frame, i.e., from the outer edge to the glass, is approximately one and three-eighth inches. The thickness from the outer sides of the case walls, 14, 16, 18 and 20, to the inner sides of the respective panels 52, 54, 42, and 40, is substantially the same. Consequently, the inside edge of the frame 26 is substantially flush with the inside surfaces of the panels 40, 42, 52 and 54.

Figure 4:
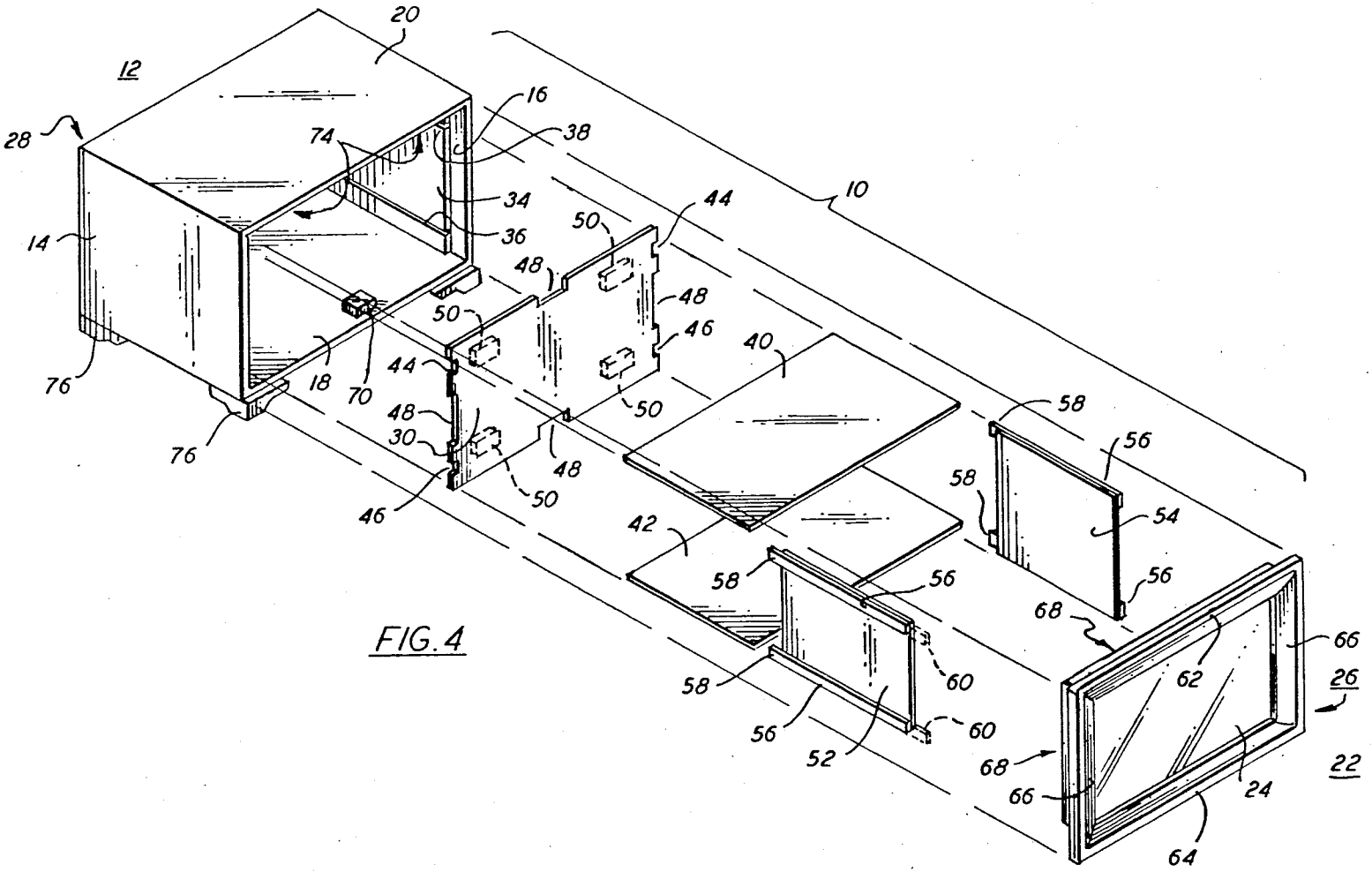
FIG. 4 is an exploded view of this embodiment of this invention.

The elements of the invention are installed generally in the order, from left to right, as shown in the exploded view of FIG. 4.

The rear panel 30, which is dimensioned to fit vertically between the bottom and top case walls 18 and 20, and horizontally between the two support panels 32 and 34, is first inserted with its spacers 50 against the facing rear wall 28. Then, the ceiling and floor panels 40 and 42 are slidably received within slots 38 and 36, to hold the rear panel 30 in place. Then, the side panels 52 and 54 are inserted, with the projections 58 fitting into the recesses 44 and 46 in the side edges of the rear panel 30. Finally, the front window 22 is installed by inserting it into the front of the case to allow the magnets 70 to couple with the plates 71.

The case of the preferred mode is made of a hardwood-veneer plywood, or other furniture grade material. However, it should be understood that the principles of this invention can be followed using metal, composite, synthetic resin, or other material, or by constructing some parts of one material and some of another.

While the invention has been described in detail with reference to a preferred embodiment, it should be understood that the invention is certainly not limited to that embodiment, and that many modificiations and variations will present themselves to those skilled in the art without departure from the scope and spirit of this invention, as defined in the appended claims.

I claim

1. A one-room doll house in the form of a rectangular box-like structure which comprises:

a back wall, a bottom wall, a top wall and a pair of side walls connected together to form said structure;

a rear panel, a floor panel, a ceiling panel and a pair of side panels spaced from the back, bottom, top and side walls respectively to permit electrical wiring to be concealed between the respective panels and walls; and a removable front window closure for the box-like structure including a transparent window panel;

the rear, floor ceiling and side panels being removably mounted in the structure to permit access to the electrical wiring as required.

2. A doll house as defined in claim 1 wherein the window closure includes a frame surrounding the window panel, the frame overlying and concealing from view the spaces between the respective panels and walls.

* * * * *